United States Patent [19]

Ogawa et al.

[11] 3,988,426

[45] Oct. 26, 1976

[54] METHOD FOR PRODUCING CARBON FIBERS

[75] Inventors: Tsutomu Ogawa; Eiichi Wakita; Takahiro Kobayashi, all of Fujishi, Japan

[73] Assignee: Asahi Kasei Kogyo Kabushiki Kaisha, Osaka, Japan

[22] Filed: Feb. 20, 1974

[21] Appl. No.: 444,133

[30] Foreign Application Priority Data

Feb. 24, 1973 Japan ..... 48-21757

[52] U.S. Cl. ..... 423/447.1; 264/29.2; 264/DIG. 19

[51] Int. Cl.[2] ..... C01B 31/02; D01F 9/12; D01F 6/40

[58] Field of Search ..... 264/29, 182; 423/447, 423/448; 260/85.5 A, 85.5 R, 80 PS, 80.71

[56] References Cited

UNITED STATES PATENTS

| | | | |
|---|---|---|---|
| 2,888,434 | 5/1959 | Shashoua | 260/80.71 |
| 3,036,052 | 5/1962 | Biev et al. | 260/85.5 R |
| 3,062,792 | 11/1962 | McConnell et al. | 260/85.5 R |
| 3,632,798 | 1/1972 | Morita et al. | 260/85.5 R |
| 3,695,925 | 10/1972 | Weil | 264/29 |
| 3,736,309 | 5/1973 | Gump et al. | 260/30.2 |
| 3,809,685 | 5/1974 | Sato et al. | 260/898 |
| 3,824,222 | 7/1974 | Shichijo et al. | 260/80.71 |

FOREIGN PATENTS OR APPLICATIONS

| | | | |
|---|---|---|---|
| 47-22655 | 6/1972 | Japan | 423/447 |

*Primary Examiner*—Jay H. Woo

*Attorney, Agent, or Firm*—Armstrong, Nikaido & Wegner

[57] ABSTRACT

Carbon fibers having high tenacity and high modulus of elasticity can be obtained with a high carbonization yield and within a short period of time by heat-carbonizing acrylonitrile polymer fibers comprising a copolymer composed mainly of acrylonitrile and a compound expressed by the general formula of

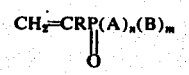

wherein R is hydrogen or methyl group, A is an alkoxy group having 1 – 4 carbon atoms, B is a halogenated alkoxy group having 1 – 4 carbon atoms (wherein halogen is chlorine, bromine or iodine), $n$ is 0 – 2, $m$ is 0 – 2 and $n + m$ is 2.

12 Claims, No Drawings

METHOD FOR PRODUCING CARBON FIBERS

DESCRIPTION OF THE INVENTION

This invention relates to a method for producing carbon fibers having high tenacities and high moduli of elasticity by carbonizing on heating fibers obtained from specified acrylonitrile copolymer within a short time.

It has been heretofore well known that carbon fibrous material superior as reinforcement materials, electro-conductive materials e.g. a heat-generating body, etc., heat-resisting materials, chemicals-resisting materials, etc. can be obtained by treating on heating acrylonitrile polymer fibers at a high temperature (usually 800° C or more). However, conventional methods for producing carbon fibers have a drawback in that yield of carbonization is low at the time of heat treatment and tenacities and moduli of elasticity of resultant carbon fibers are not sufficient. Accordingly, we have been earnestly studying how to overcome the drawback of the conventional methods and to establish a novel method which enables to provide carbon fibers having superior tenacities and moduli of elasticity within a shorter period of time and with a higher carbonization yield. As the result of the study, we have found that the acrylonitrile polymer fibers obtained by copolymerizing compounds having a certain specified structure show notable effectiveness and completed the present invention.

The present invention resides in a method for producing carbon fibers which is characterized in heat-carbonizing acrylonitrile polymer fibers comprising a copolymer composed mainly of acrylonitrile and a compound (which will be referred to hereinafter as monomer P) expressed by the general formula of $$CH_2{=}CRP(A)_n(B)_m \quad (\underset{\underset{O}{\|}}{P})$$

wherein R is hydrogen or methyl group, A is an alkoxy group having 1 – 4 carbon atoms, B is a halogenated alkoxy group (wherein halogen is chlorine, bromine or iodine), $n$ is an integer of 0 – 2, $m$ is an integer of 0 – 2 and $n + m = 2$, the contents of acrylonitrile and said compound in said copolymer being more than 85% by weight and 0.05 – 15% by weight based upon the weight of said copolymer, respectively.

Representative monomers P which are one component of the copolymer used in the method of the present invention include bis-chloromethylvinyl phosphonate, bis-bromoethylvinyl phosphonate, bis-chloroethylvinyl phosphonate, bis-bromoethylmethallyl phosphonate, bis-chloroethylmethallyl phosphonate, bis-chlorobutylvinyl phosphonate, ethoxy-bromoethoxyvinyl phosphonate, but it goes without saying that they are not limited only to those above-mentioned.

The production of the copolymers comprising acrylonitrile and a monomer P used in the present invention can be easily carried out according to a common radical polymerization manner. Namely, the use of a common radical initiator, of a redox type initiator such as ammonium persulfate-sodium hydrogen sulfite, potassium persulfate-sodium hydrogen sulfite-ferric chloride, potassium persulfate-sodium hydrogen phosphate or the like, a peroxide such as benzoyl peroxide, lauroyl peroxide, hydrogen peroxide, or the like, an azo compound such as azo-bis-isobutyronitrile, $\alpha,\alpha'$-azo-bis-($\alpha,\alpha'$-dimethylvaleronitrile) or the like, a radical-forming organo-metallic compound, the use of irradiation of radiant ray or light, or the like, is relied on, but it goes without saying that the method of the present invention is not limited only to those which use the above-mentioned compounds or rays.

The amount of a radical initiator used or other conditions can be determined as in well known radical polymerization methods. The range of the proportion of the amount of monomer P copolymerized in the copolymer is 0.05 – 15% by weight based upon the weight of the copolymer, preferably 0.1 – 10% by weight, and most desirably 0.5 – 3% by weight. If the proportion exceeds 15% by weight, high polymerization yield usually cannot be obtained and also it is difficult to make the resulting copolymer into fibers. Further, when the resulting copolymer is made into carbon fibers, the tenacity and modulus of elasticity of the resulting carbon fibers are low. Accordingly, the proportion exceeding 15% by weight is not desirable. Further, in the present invention, it is possible to use three or more components copolymer which is prepared by copolymerizing three or more components including a following third comonomer component according to the common sense of the production of polyacrylonitrile.

As the third comonomer components, it is possible to list mono- or dicarboxylic acids such as acrylic acid, methacrylic acid, maleic acid, itaconic acid and the like or salts thereof; esters of acrylic acid such as methyl acrylate, ethyl acrylate, butyl acrylate and the like; esters of methacrylic acid such as methyl methacrylate, ethyl methacrylate, butyl methacrylate, hydroxyethyl methacrylate and the like; mono- or diesters of dicarboxylic acids such as monomethyl itaconate, dimethyl itaconate and the like; amides of unsaturated fatty acids, and mono- and disubstitutes thereof such as acrylamide, acrylmonomethylamide, acryldimethylamide, acrylmonoethylamide, acryldiethylamide, acrylmethylolamide, methacrylamide, methacrylmonomethylamide, methacryldimethylamide and the like; $\alpha$-substituted acrylonitriles such as $\alpha$-chloroacrylonitrile, $\alpha$-methylacrylonitrile, $\alpha$-propylacrylonitrile and the like; vinyl esters of carboxylic acids such as vinyl acetate, vinyl propionate and the like; unsaturated sulfonic acids and their salts such as vinyl sulfonic acid, acryl sulfonic acid, methacryl sulfonic acid, styrene sulfonic acid and the like; vinyl chloride, vinylidene chloride, styrene, vinylpyridine, etc. and other copolymerizable compounds having >C=C< group. In this case, the sum content of the above-mentioned components other than acrylonitrile is 0.5 – 15% by weight based upon the weight of the copolymer and the content of acrylonitrile is controlled so as to excel 85%. Three-component copolymer containing about 0.5 – 3% of a monomer P and 0.5 – 10% of vinylidene chloride is particularly preferable to satisfy the object of the present invention. Any polymerization manner of solution polymerization, emulsion polymerization and suspension polymerization is operable but an emulsion or suspension polymerization manner in aqueous medium is particularly preferable. Resultant copolymers are dissolved in a known solvent, for example, a concentrated solution of an inorganic compound such as nitric acid, zinc chloride, thiocyanate or the like, or an organic solvent such as dimethylformamide, dimethylacetamide, dimethylsulfoxide, $\gamma$-butyrolactone or the like to give a viscous spinning solution. The viscous spinning solution is extruded through narrow holes and coagulated into fibrous form. Any of known spinning processes of wet spinning, semi-wet spinning, dry spinning, solvent spinning can be applied. Resultant fibrous materials are oriented by stretching by using as a medium, cold water, hot water, hot air, steam, hot plate, etc. to produce acrylonitrile polymer fibers.

The production of carbon fibers from acrylonitrile polymer fibers according to the present invention is carried out based upon the well-known production method of carbon fibers from conventional acrylonitrile polymer fibers. That is, when these fibers are heated commonly at a temperature of 700° C or higher, preferably up to about 1000° – 1800° C, they are carbonized into carbon fibers. If necessary, they can be converted into graphite fibers by further heating up to about 2500° – 2800° C. As for heat treatment, a method in which temperature is gradually elevated for heating is preferably used, but it is particularly preferable to carry out a preliminary treatment in the air or in any other oxidative atmosphere at 180° – 300° C for 0.5 – 30 hours. There is no special limitation as to the atmosphere of heat treatment, but during this step, acrylonitrile polymer fibers are oxidated and as a result become inflammable i.e. flame-resisting, whereby a property that the resulting fibers do not burn nor vanish even in the subsequent carbonization treatment, is given. The carbonization treatment can be carried out commonly under reduced pressure or in the atmosphere of a non-oxidative gas under the atmospheric pressure or under pressure, such as nitrogen, argon, hydrogen, etc., and in the continuous process, it is preferable to carry out the treatment under pressure.

Thus carbon fibers can be obtained within a shorter period of time and with a higher yield of carbonization, while holding the shape prior to the heat-treatment. The resultant fibers are characterized in that they are superior in tenacity and modulus of elasticity as compared with the carbon fibers obtained from the fibers of acrylonitrile homopolymer as well as acrylonitrile copolymer containing the above-mentioned third component but not containing the monomer P.

Following specific examples are given to illustrate the method of the present invention which are not intended to limit the scope of claim.

EXAMPLE 1

A copolymer containing 97% by weight of acrylonitrile and 3% by weight of bis-chloroethylvinyl phosphonate was prepared by the suspension polymerization in aqueous medium by using as a polymerization initiator, ammonium persulfate-sodium hydrogen sulfite, and fibers were produced from this copolymer by a wet spinning process which utilizes nitric acid. The resultant acrylonitrile polymer fibers of 310 denier and 200 filaments were heated at 230° C for 4 hours in the atmosphere of air under tension to turn into flame-resistant state, and then carbonized by heating up to a high temperature of 1100° C in the atmosphere of argon. The resultant carbonized fibers had a tenacity of 235 Kg/mm$^2$ and a modulus of elasticity of 17.3 T/mm$^2$. The carbonization yield after carbonization was 62.7% as calculated from raw fibers (before heat-treatment). These values of the characteristic properties are listed in Table together with those of other Examples and Comparative Examples. Tenacities and moduli of elasticity were measured with Tensilon UTM-II type (supplied from Toyo Measurement Apparatus Co., Japan) and an average value of 25 monofilaments was taken. Sectional areas were determined by the calculation of measured diameter of fibers under a microscope.

EXAMPLE 2

Acrylonitrile polymer fibers of 300 denier and 200 filaments containing acrylonitrile and copolymerized component(s) described in Nos. 2 – 14 of Table and having their ratios described also therein, were prepared according to the same process as that of Example 1. Carbon fibers of high tenacity and high modulus of elasticity whose values are described in Nos. 2 – 14 of Table, were obtained by the same heat treatment as that of Example 1.

EXAMPLE 3

Acrylonitrile polymer fibers of 290 denier and 200 filaments containing acrylonitrile and copolymerized components described in Nos. 15 and 16 of Table and having their ratios described also therein, were prepared according to the same process as in Example 1. The resultant acrylonitrile polymer fibers were heated (or oxidated) for 1.5 hours at 260° C in air while maintaining a fixed length, and then subjected to heat-treatment in the atmosphere of argon up to 1100° C to effect carbonization. The tenacity and the modulus of elasticity of the resultant carbon fibers and the carbonization yield after carbonization thereof are described in Nos. 15 and 16 of Table.

EXAMPLE 4

Acrylonitrile polymer fibers of 304 denier and 200 filaments consisting of copolymer of acrylonitrile and bis-chloroethylvinyl phosphonate and having their ratio described in Nos. 17 – 20 of Table were prepared according to the same process as that of Example 1. The resultant fibers were heated at 245° C, for 2 hours, in the atmosphere of air and under tension and as a result, flame-resistant fibers were obtained. The fibers thus obtained were then carbonized by heating up to 1100° C in the atmosphere of argon. The characteristic properties of the resultant carbon fibers and the carbonization yield are described in Nos. 17 – 20 of Table.

COMPARATIVE EXAMPLE 1

Acrylonitrile homopolymer fibers having 305 denier and 200 filaments were prepared according to the same process as that of Example 1 and heated (or oxidated) under the same conditions as those of Example 1. Thus oxidated fibers were still combustible and additional 5 hours were required until they were turned into flame-resistant state. The oxidated fibers were carbonized as in Example 1 whereby tenacity and modulus of elasticity of the resultant fibers were 116 Kg/mm$^2$ and 10.5 T/mm$^2$, respectively, as seen in No. 21 of Table.

COMPARATIVE EXAMPLE 2

Acrylonitrile polymer fibers of 298 denier and 200 filaments containing 91.5% by weight of acrylonitrile, 8% by weight of methyl acrylate and 0.5% by weight of sodium metallylsulfonate were prepared according to the same process as that of Example 1 and heated (or oxidated) under the same conditions as in Example 3. The resulting fibers were still combustible and additional 1.5 hours were required until they were turned into flame-resistant state. The oxidated fibers were carbonized as in Example 1 whereby the tenacity and modulus of elasticity had so low values as 83 Kg/mm² and 7.0 T/mm², respectively, as seen in No. 22 of Table. The yield of carbonization was 41.3% as calculated from raw fibers.

COMPARATIVE EXAMPLE 3

Acrylonitrile polymer fibers of 307 denier and 200 filaments containing 97.5% by weight of acrylonitrile and 2.5% by weight of methyl acrylate were prepared according to the same process as in Example 1 and the resulting fibers were heated (or oxidated) under the same conditions as in Example 4. Thus treated fibers were still combustible and additional 2.5 hours were required until they were turned into flame-resistant state. The oxidated fibers were carbonized as in Example 1 whereby the tenacity and modulus of elasticity of the resultant carbon fibers has so low values as 126 Kg/mm² and 11.3 T/mm², respectively, as seen in No. 23 of Table. The carbonization yield after carbonization was 45.6%.

Table

| No. | No. of Corresponding Examples or Comparative Examples | Components of copolymer: Kinds | Components of copolymer: Ratio (by weight) | Conditions of flame-resisting treatment temp. (° C) × time (hr.) | Characteristic properties of carbon fibers: Tenacity (Kg/mm²) | Characteristic properties of carbon fibers: Modulus of elasticity (T/mm²) | Carbonization yield (%) |
|---|---|---|---|---|---|---|---|
| 1 | Ex. 1 | AN*/bis-chloroethylvinyl phosphonate | 97/3 | 230 × 4 | 235 | 17.3 | 62.7 |
| 2 | Ex. 2 | AN/bis-bromoethylvinyl phosphonate | 97/3 | " | 228 | 16.7 | 62.5 |
| 3 | " | AN/bis-chloroethylmethallyl phosphonate | 97/3 | " | 241 | 17.5 | 61.8 |
| 4 | " | AN/bis-chloromethylvinyl phosphonate | 97.5/2.5 | " | 225 | 17.2 | 62.8 |
| 5 | " | AN/diethylvinyl phosphonate | 97.5/2.5 | " | 197 | 15.2 | 60.5 |
| 6 | " | AN/bis-chlorobutylvinyl phosphonate | 97.5/2.5 | " | 221 | 16.2 | 62.1 |
| 7 | " | AN/bis-chloroethylvinyl phosphonate | 99.5/0.5 | " | 237 | 20.6 | 63.6 |
| 8 | " | " | 92/8 | " | 214 | 15.8 | 59.7 |
| 9 | " | " | 85/15 | " | 132 | 8.9 | 51.6 |
| 10 | " | AN/bis-chloroethylvinyl phosphonate/methyl acrylate | 95/3/2 | " | 226 | 16.4 | 61.3 |
| 11 | " | " | 80/15/5 | " | 79 | 7.1 | 50.3 |
| 12 | " | AN/bis-chloroethylvinyl phosphonate/sodium methallylsulfonate | 98/1.5/0.5 | " | 243 | 18.3 | 62.9 |
| 13 | " | AN/bis-bromoethylvinyl phosphonate/acrylamide | 95/3/2 | " | 229 | 17.1 | 61.5 |
| 14 | " | AN/bis-chloromethylvinyl phosphonate/sodium methallylsulfonate | 97/2.5/0.5 | " | 217 | 16.9 | 61.4 |
| 15 | Ex. 3 | AN/bis-chloroethylvinyl phosphonate/vinylidene chloride | 95.5/1.5/3 | 260 × 1.5 | 218 | 17.6 | 61.3 |
| 16 | " | AN/bis-chlorobutylvinyl phosphonate/vinylidene chloride | 96/2.5/1.5 | " | 224 | 18.1 | 61.7 |
| 17 | Ex. 4 | AN/bis-chloroethylvinyl phosphonate | 99.8/0.2 | 245 × 2 | 209 | 16.0 | 53.2 |
| 18 | " | " | 98/2 | " | 229 | 18.3 | 62.4 |
| 19 | " | " | 95/5 | " | 215 | 16.1 | 61.6 |
| 20 | " | " | 90/10 | " | 186 | 13.8 | 58.7 |
| 21 | Compar. Ex. 1 | AN homopolymer | 100 | 230 × 9 | 116 | 10.5 | 51.8 |
| 22 | Compar. Ex. 2 | AN/methyl acrylate/sodium methallylsulfonate | 91.5/8/0.5 | 260 × 3 | 83 | 7.0 | 41.3 |
| 23 | Compar. Ex. 3 | AN/methyl acrylate | 97.5/2.5 | 245 × 4.5 | 126 | 11.3 | 45.6 |

*AN: Acrylonitrile

As evident from the foregoing description, carbon fibers obtained from the acrylonitrile polymer fibers of the present invention are characterized in that they are superior in tenacity and modulus of elasticity; the carbonization yield is high; and they can be prepared within a short period of time. Thus, their commercial values are great.

What is claimed is:

1. A method for producing carbon fibers which comprises subjecting acrylonitrile polymer fibers to a preliminary heat treatment in an oxidative atmosphere at a temperature of 180° to 300° C. and a subsequent carbonization heat treatment at a temperature in the range from 700° C to about 2800° C which acrylonitrile polymer fibers comprise a copolymer composed mainly of acrylonitrile and a comonomer expressed by the general formula of $$CH_2{=}CR\underset{\underset{O}{\|}}{P}(A)_n(B)_m$$

wherein R is hydrogen or methyl group, A is an alkoxy group having 1 – 4 carbon atoms, B is a halogenated alkoxy group having 1 – 4 carbon atoms wherein halogen is chlorine, bromine or iodine, $n$ is an integer of 0 – 2, $m$ is an integer of 0 – 2 and $n + m$ is 2, the contents of acrylonitrile and said comonomer in said copolymer being more than 85% by weight and 0.05 – 15% by weight based upon the weight of said copolymer, respectively.

2. A method according to claim 1 wherein said copolymer further contains a third component monomer copolymerizable with acrylonitrile and said comonomer and the sum of the amounts of said comonomer and said third component monomer is 0.5 – 15% by weight based upon the weight of said copolymer.

3. A method according to claim 1 wherein the content of said comonomer in said copolymer is 0.1 – 10% by weight based upon the weight of said copolymer.

4. A method according to claim 1 wherein the content of said comonomer in said copolymer is 0.5 – 3% by weight based upon the weight of said copolymer.

5. A method according to claim 2 wherein said third component monomer is at least one member selected from the group consisting of vinylidene chloride, acrylamide, methyl acrylate and sodium methallylsulfonate.

6. A method according to claim 2, wherein said third component monomer is vinylidene chloride and the content of vinylidene chloride in said copolymer is 0.5 – 10% by weight based upon the weight of said copolymer.

7. A method for producing carbon fibers which comprises heat-carbonizing acrylonitrile polymer fibers at a temperature in the range from 700° C to about 2800° C comprising a copolymer composed mainly of acrylonitrile and a comonomer expressed by the general formula of $$CH_2{=}CR\underset{\underset{O}{\|}}{P}(B)_m$$

wherein R is hydrogen or methyl group, B is a halogenated alkoxy group having 1 – 4 carbon atoms wherein halogen is chlorine, bromine or iodine, *m* is 1 or 2, and the contents of acrylonitrile and said comonomer in said copolymer are more than 85% by weight and 0.05 – 15% by weight based upon the weight of said copolymer, respectively.

8. A method according to claim 7 wherein said copolymer further contains a third component monomer copolymerization with acrylonitrile and said comonomer and the sum of the amounts of said comonomer and said third component monomer is 0.05 – 15% by weight based upon the weight of said copolymer.

9. A method according to claim 7 wherein the content of said comonomer in said copolymer is 0.1 – 10% by weight based upon the weight of said copolymer.

10. A method according to claim 7 wherein the content of said comonomer in said copolymer is 0.5 – 3% by weight based upon the weight of said copolymer.

11. A method according to claim 8 wherein said third component monomer is at least one member selected from the group consisting of vinylidene chloride, acrylamide, methyl acrylate and sodium methallylsulfonate.

12. A method according to claim 8 wherein said third component monomer is vinylidene chloride and the content of vinylidene chloride in said copolymer is 0.5 – 10% by weight based upon the weight of said copolymer.

* * * * *